US005304107A

United States Patent [19]

Jones

[11] Patent Number: 5,304,107

[45] Date of Patent: Apr. 19, 1994

[54] EXERCISE MACHINE

[76] Inventor: Arthur A. Jones, 1155 NE. 77th St., Ocala, Fla. 32670

[21] Appl. No.: 145

[22] Filed: Jan. 4, 1993

Related U.S. Application Data

[63] Continuation-in-part of Ser. No. 947,284, Sep. 15, 1992.

[51] Int. Cl.[5] ..... A63B 21/062

[52] U.S. Cl. ..... 482/98; 482/72; 482/97; 482/100; 482/134; 482/137

[58] Field of Search ..... 482/72, 73, 94, 97-103, 482/112-113, 133-138, 908

[56] References Cited

U.S. PATENT DOCUMENTS

| | | | |
|---|---|---|---|
| 3,708,166 | 1/1973 | Annas | 482/137 X |
| 4,336,934 | 6/1982 | Hanagan et al. | 482/97 X |
| 4,390,179 | 6/1983 | Szkalak | 482/100 |
| 4,634,127 | 1/1987 | Rockwell | 482/139 X |
| 4,817,943 | 4/1989 | Pipasik | 482/97 |
| 4,872,668 | 10/1989 | McGillis et al. | 482/113 |
| 4,872,670 | 10/1989 | Nichols | 482/134 X |
| 4,964,632 | 10/1990 | Rockwell | 482/100 |
| 4,982,955 | 1/1991 | Heasley | 482/100 |
| 5,002,269 | 3/1991 | Jones | 482/100 X |
| 5,050,873 | 9/1991 | Jones | 482/138 |
| 5,141,480 | 8/1992 | Lennox et al. | 482/908 X |

FOREIGN PATENT DOCUMENTS 279412 6/1990 German Democratic Rep. ... 482/97

OTHER PUBLICATIONS

The Pulldown Latissimus Machine Advertised in Recreation, Sport & Leisure, Sep. 1982, p. 14.

*Primary Examiner*—Robert Bahr

*Attorney, Agent, or Firm*—William E. Mouzavires

[57] ABSTRACT

A rowing exercise machine including a seat, a chest pad located forwardly of the seat, a movement arm to be pivoted about a horizontal axis by the exerciser while the chest pad limits forward movement of the exerciser, and a weight stack connected to the movement arm to impose a resistance to movement of the movement arm by the exerciser in one direction. A vertical pin is connectable to the resistance weight while being connected to the movement arm by a transmission including a vertical drive rod whose upper end is connected to the movement arm by a first linkage and whose lower end is connected to the pin by a second linkage located below the level of the seat. The chest pad is adjustable by a parallelogram linkage which mounts the chest pad relative to a fixed frame.

17 Claims, 3 Drawing Sheets

EXERCISE MACHINE

RELATED APPLICATION

The present invention is a continuation-in-part of copending U.S. Pat. Application Ser. No. 07/947,284, filed Sep. 15, 1992, entitled EXERCISE MACHINES AND METHODS. The disclosure of the aforementioned application is hereby incorporated by reference into the subject application as part hereof.

OBJECTS OF THE PRESENT INVENTION

The present invention is directed to a novel and improved exercise machine and although it is particularly suitable for use as a rowing exercise machine, its applicability to other types of exercise machines will be apparent and therefore the present invention need not be limited to rowing exercise machines.

An object of the present invention is to provide improvements to machines and apparatus which exercise the arms and chest muscles. Included herein is a novel and improved rowing exercise machine. Further included herein are such exercise machines which are safe and effective and easy to use. A further object of the present invention is the provision of such machines having a novel and improved transmission between a movement arm which is moved by the exerciser and a resistance which opposes the movement arm.

SUMMARY OF INVENTION

In one preferred embodiment, the present invention is applied to a rowing exercise machine having a movement arm pivotable about a horizontal axis by the exerciser while seated and restrained against forward movement by a chest pad. A weight stack opposes movement of the movement arm to which it is connected by means of a vertical drive rod. An upper portion of the drive rod is pivotally connected to the movement arm by a first linkage while a lower portion of the drive rod is connected to the weight stack pin by means of a second linkage located preferably below the level of the seat. When the exerciser draws the movement arm toward the exerciser, the weight stack pin will be lifted from the bottom to lift one or more weights in resistance to the movement arm. In the preferred embodiment, the movement arm is a yoke structure including opposite arms respectively grasped by the exerciser and further, the chest pad is adjustably mounted by a linkage mechanism.

DRAWINGS

Other objects and advantages of the present invention will become apparent from the following more detailed description taken in conjunction with the attached drawings in which.

DETAILED DESCRIPTION

Figure 1:
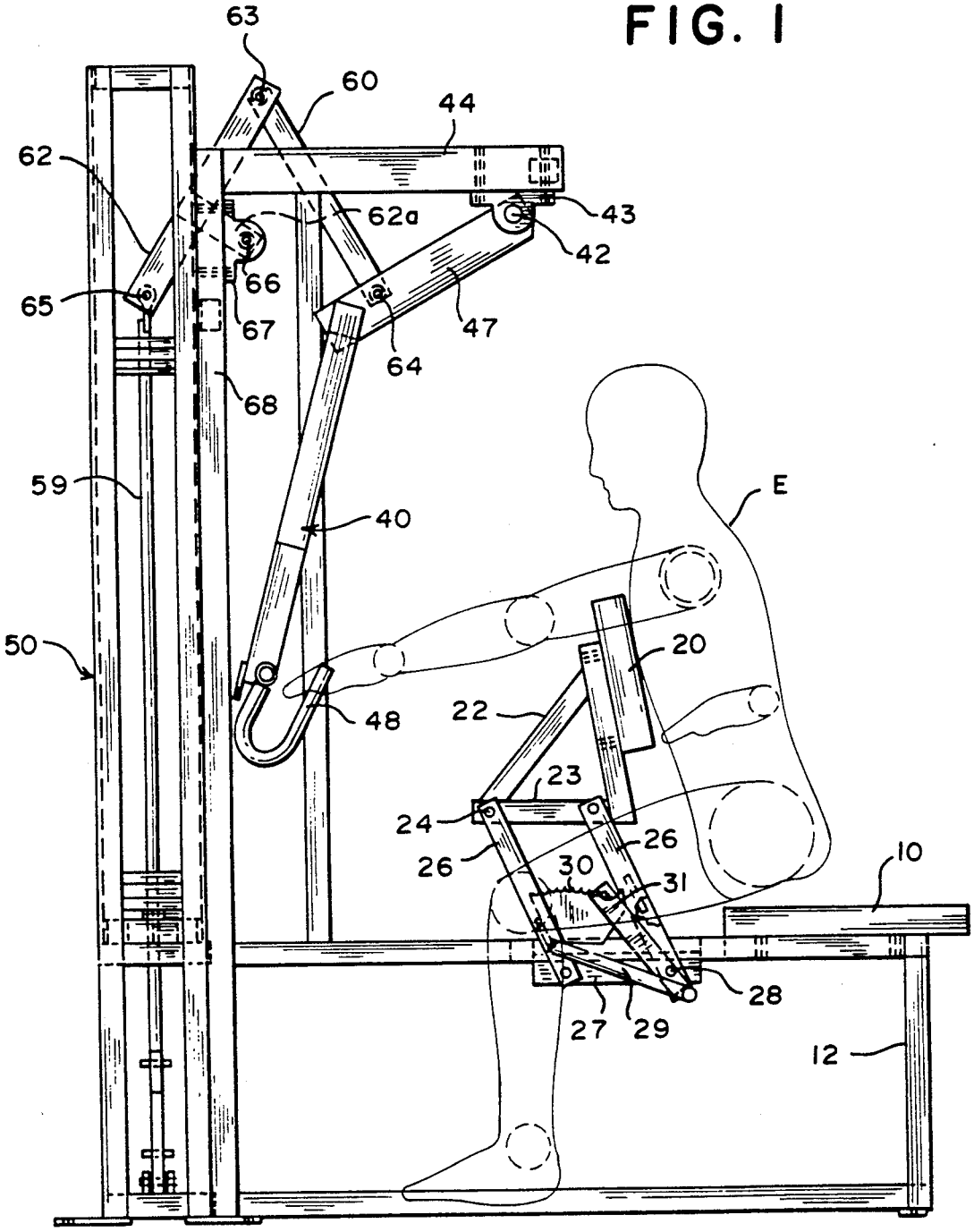
FIG. 1 is a side elevational view of a rowing exercise machine constituting a preferred embodiment of the present invention and also showing an outline of an exerciser using the machine.
Figure 3:
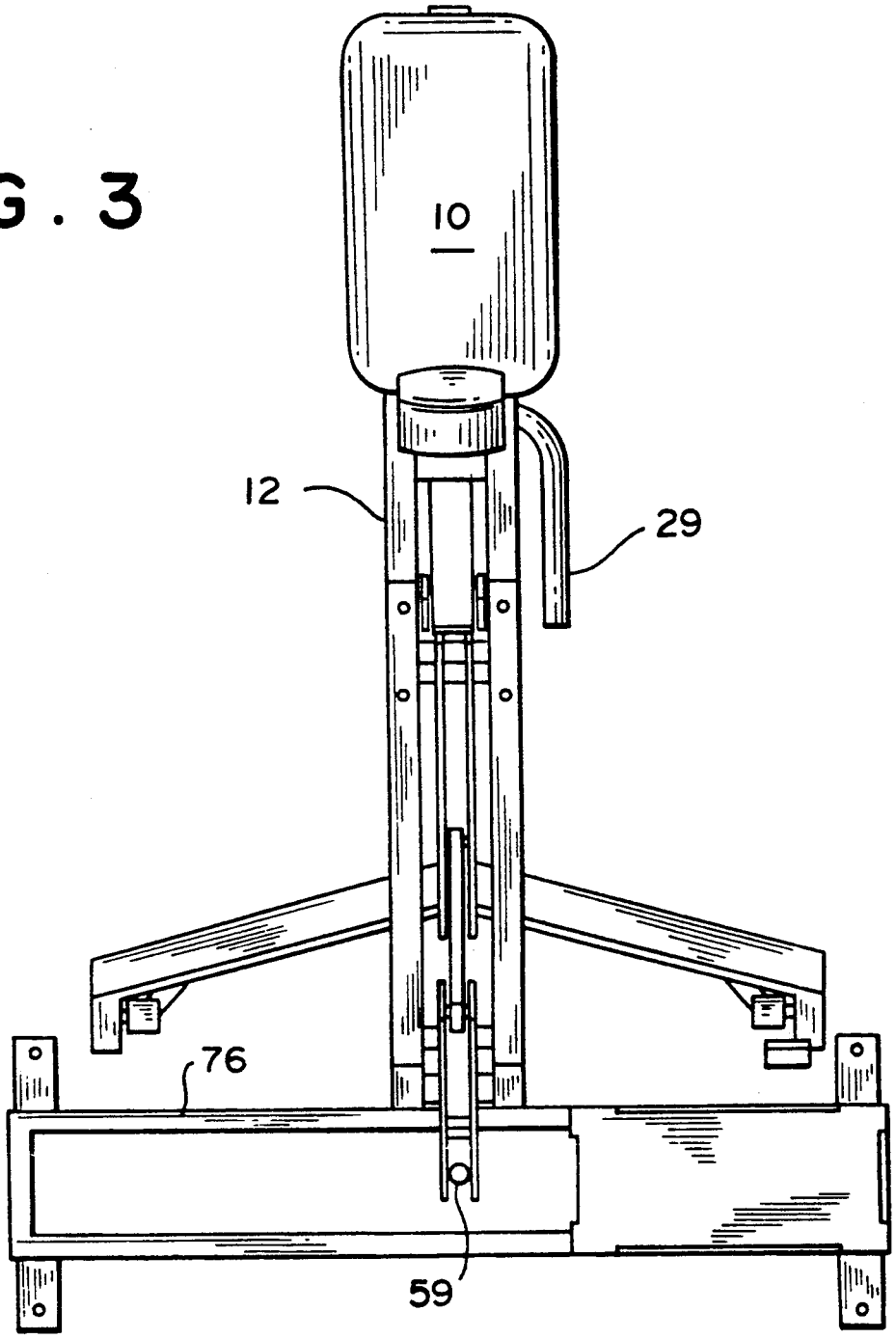
FIG. 3 is a plan view of the machine.

Referring now to the drawings in detail, there is shown for illustrative purposes only, a machine constituting a preferred embodiment of the present invention and which may be termed a "Rowing Machine" for exercising muscles of the upper torso including the arms. The machine includes a seat 10 secured on a frame generally designated 12 and which may include elongated rails or tubular stock of high strength metallic material or any other suitable material as long as it provides the necessary strength and weight. To perform an exercise, the exerciser E straddles the frame 12 with his legs while seated on seat 10 with the legs being bent at the knees as shown in FIG. 1. In addition, forward movement of the exerciser E is restrained by a chest pad 20 which in the preferred embodiment is secured to a generally triangular frame generally designated 22 which is mounted by a parallelogram linkage for movement into adjusted positions relative to frame 12. The parallelogram linkage includes the lower leg 23 of the triangular frame 22, opposed parallel links 26 pivotally mounted to leg 23 by pivots 24 and a link 27 fixed relative to the frame 12 with parallelogram links 26 pivotally mounted to link 27 by pivots 28. Once adjusted into the desired position, the parallelogram linkage is held in place by a latch which in the preferred embodiment includes a latch plate 30 and a latching lever 31 having a pin receivable in notches of the latch plate 30 upon actuation by means of a handle 29, see also FIG. 3.

Figure 2:
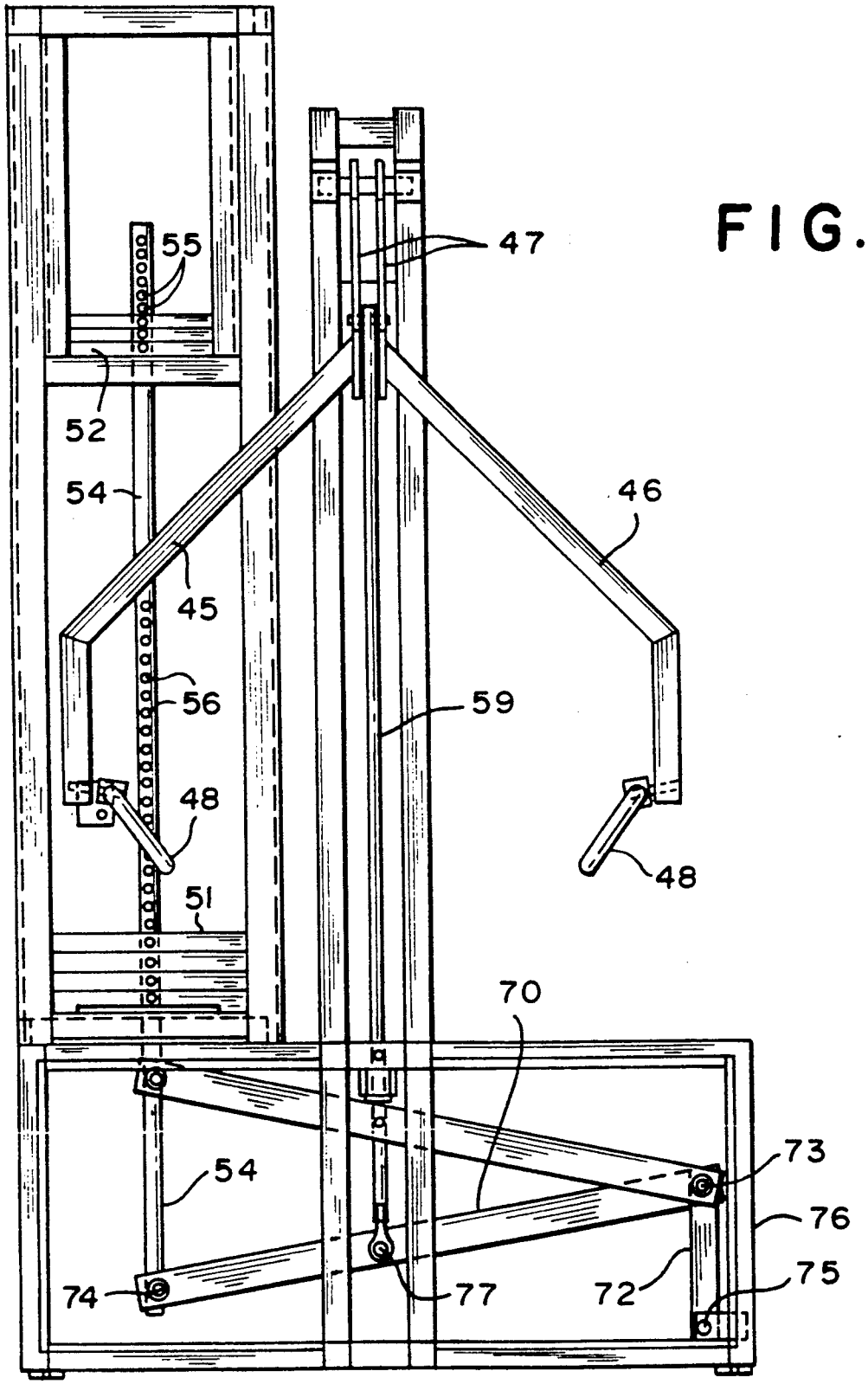
FIG. 2 is an end view of the machine.

To exercise the muscles of the arms and other parts of the upper torso, the user sits on seat 10 as shown in FIG. 1 and grasps with his hands a movement arm generally designated 40, and draws the movement arm towards himself/herself by pivoting the movement arm about a generally horizontal axis shown at 42 in FIG. 1. Such movement simulates a rowing movement. The pivot pin 42 or shaft of the movement arm is mounted in bearing blocks 43 which in turn are secured to a fixed frame 44. As shown in FIGS. 1 and 2, movement arm 40 has a yoke-type configuration including opposed arms 45 and 46 which converge to parallel plates 47 to which they are fixed, the plates being mounted for pivotal movement on pivot pin 42. It will be understood that the arms 45 and 46 move in unison about pivot pin 42. At the lower ends of the arms, a pair of handlebars 48 are provided by which the exerciser may manipulate the movement arm 40. Both handlebars 48 are mounted for pivotal movement relative to arms 45 and 46 to allow self-adjustment during an exercise. The vertical length of the movement arm and location of its horizontal pivot axis 42 are designed relative to the location of the seat 10 such that when the exerciser pivots the movement arm it will simulate a rowing movement in the exerciser's arms and upper torso.

Movement of the movement arm 40 by the exerciser in a rearward direction, that is counter-clockwise as used in FIG. 1, is opposed by a resistance preferably a yieldable resistance in the form of one or more dead weights such as may be included in a weight stack. Although any suitable weight stack may be employed, the preferred embodiment utilizes a compound weight stack as disclosed in my U.S. Pat. No. 4,834,365 entitled COMPOUND WEIGHT SYSTEM. The disclosure of the aforementioned U.S. Pat. No. 4,834,365 is hereby incorporated by reference into the instant application as part hereof. In the instant embodiment, the compound weight stack includes a vertical frame generally designated 50 extending vertically at the forward end of frame 12 extending vertically as best shown in FIGS. 1 and 2. The compound weight stack includes lower and upper weights 51 and 52 which may be independently connected to a vertical rod or pin 54 by keys which are placed through apertures in the weight plates and apertures 56 into pin 54, see FIG. 2. A more detailed description of a compound weight stack may be gained from reference to my above-identified U.S. Pat. 4,834,365.

Transmission of movement from the movement arm 40 to the resistance weight stack to lift one or more weights is achieved through an improved system including a vertical drive member which may be a rod or shaft 59 which extends generally parallel to the weight stack pin 54 while being spaced laterally from the latter as best shown in FIG. 2. A first linkage, including links 60 and 62, pivotally connects the movement arm 40 to the upper end of drive rod 59 as best shown in FIG. 1. Link 60 which may be termed "intermediate link" is pivotally connected by pivot 64 to an intermediate location of movement arm 40 on plate 47 while link 62 which may be termed "crank" is pivotally connected by pivot 65 to the upper end of drive rod 59. Additionally, links 60 and 62 are pivotally connected to each other at pivot 63. Link 62 is also pivotally mounted to a fixed frame shown as vertical member 68 in FIG. 1 by means of a pivot pin 66 journalled in mounting blocks 67 in turn fixed to the frame. Location of pivot pin 66 is intermediate the ends of link 62. A small arm **62*a* fixed to link 62 is utilized for mounting it on pivot pin 66 as shown in FIG. 1**.

Drive rod 59 is operatively connected to the weight stack pin 54 to raise the same when the exerciser draws the movement arm 40 towards himself/herself by means of a second linkage including, in the preferred embodiment, a main link or lever 70 pivotally connected at one end portion thereof by pivot 73 to an idler link 72 which in turn is pivotally mounted by pivot 75 to a stationary frame 76 positioned below the resistance weight stack in generally the same vertical plane. Intermediate the ends of the main link 70 is a pivot 77 which pivotally connects the latter to the drive rod 59 so that when the drive rod 59 is raised by linkage 60, 62, the main link will pivot upwardly about pivot 73. Such motion is transmitted to the weight stack pin 54 to lift the same by means of a pivotal connection at pivot 74 of the main link 70 to the lower end of the weight stack pin. Being connected to the weight stack pin 54, one or more weights 51, 55 will also be raised at the same time.

When the exerciser releases force on the movement arm 40, the weights 51, 52 and their pin 54 will descend by gravity, of course, returning the main link 70, drive rod 59 and links 60 and 62 to the starting position. The exercise is of course repeated as desired.

Although a preferred embodiment of the present invention has been shown and described, it will be apparent to those skilled in the art that the invention may be applied in other specific embodiments but without departing from the scope of the invention as indicated in the appended claims.

What is claimed is:

1. A rowing exercise machine comprising in combination, a seat extending in a generally horizontal plane for receiving an exerciser, a movement arm pivotable about a generally horizontal axis and having a pair of laterally spaced handles for receiving the hands of the exerciser for pivoting the movement arm about said axis, said movement arm having a position with the handles spaced forwardly of an exerciser's outstretched arms such that when the exerciser pivots the movement arm by drawing the movement arm towards the exerciser it will simulate a rowing movement, resistance means including at least one weight for opposing pivotal movement of the movement arm in one direction about said axis, transmission means connecting the weight and the movement arm such that when the movement arm is pivoted about said axis towards the exerciser the weight will be lifted and when the movement arm pivots in an opposite direction away from the exerciser the weight will be lowered, said transmission means including a generally vertically extending drive member, a first linkage interconnecting the movement arm and the drive member, and a second linkage located below said plane and interconnecting the drive member and the weight and wherein said second linkage includes a main lever pivotally connected to the resistance weight and further being pivotally interconnected at an intermediate location to said drive member, said lever also being pivotally mounted to a fixed frame and wherein there is further included an idler lever pivotally mounted to the fixed frame, and said main lever is pivotally connected to said idler lever.

2. The machine defined in claim 1 further including a chest pad and means mounting the chest pad above said seat to be engageable with a chest area of the exerciser to limit forward movement of the exerciser during a rowing exercise.

3. The machine defined in claim 2 wherein said means mounting the chest pad includes a linkage and a latch for holding the linkage in adjusted position.

4. The machine defined in claim 3 wherein said chest pad linkage includes a parallelogram linkage.

5. The machine defined in claim 1 wherein said first linkage includes two links pivotally interconnected while being respectively pivotally connected to the movement arm and the drive member.

6. The machine defined in claim 5 wherein one of said links is pivotally mounted intermediate its ends to a stationary frame.

7. The machine defined in claim 6, wherein the drive member is pivotally connected to said second linkage intermediate the ends of the second linkage.

8. A machine defined in claim 7 wherein said resistance means includes a generally vertically extending pin connectable to the weight and wherein said second linkage is pivotally connected to a lower end portion of said pin.

9. The machine defined in claim 8 wherein said movement arm includes a yoke pivotally mounted to a stationary frame and including opposite arms, and said handles are pivotally mounted to lower end portions of said yoke arm.

10. The machine defined in claim 8 further including a chest pad and means mounting the chest pad above said seat to be engageable with a chest area of the exerciser to limit forward movement of the exerciser, said means mounting the chest pad including a parallelogram linkage.

11. The machine defined in claim 1 wherein said movement arm includes a yoke pivotally mounted to a stationary frame and including opposite arms, and said handles are pivotally mounted to lower end portions of said yoke arms.

12. The machine defined in claim 1 wherein said resistance means includes a vertically extending pin connectable to said weight, and wherein said main lever is pivotally connected to a lower portion of said weight pin, and further wherein said main lever is located below said horizontal plane of said seat.

13. A rowing exercise machine comprising in combination, a seat for receiving an exerciser, a movement arm pivotable about a generally horizontal axis by the exerciser while seated on said seat, said movement arm having a position with the movement arm spaced forwardly of an exerciser's outstretched arms such that when the exerciser pivots the movement arm by drawing the movement arm towards the exerciser it will simulate a rowing movement, resistance means for opposing pivotal movement of the movement arm in one direction about said axis, transmission means connecting the resistance means and the movement arm such that when the movement arm is pivoted about said axis towards the exerciser the resistance will be moved in one direction and when the movement arm pivots in an opposite direction away from the exerciser, the resistance will be moved in a direction opposite said first direction, said transmission means including a generally vertically extending drive member, a first linkage interconnecting the movement arm and the drive member, and a second linkage interconnecting the drive member and the resistance, said second linkage including a main lever located generally below the level of the seat and an idler lever pivotally mounted to a fixed frame while being pivotally connected to the main lever.

14. The machine defined in claim 13 wherein said resistance means is a weight stack including at least one resistance weight, and a vertical pin connectable to said weight, and wherein said lever is connected to a lower portion of said pin.

15. The machine defined in claim 14 wherein said transmission means includes a generally vertically extending drive member pivotally connected to said lever and intermediate ends of the lever.

16. The machine defined in claim 15 wherein said first linkage includes a pair of links pivotally connected to each other with one of said pair being connected to said movement arm and the other of said pair being connected to said drive member.

17. The machine defined in claim 16 wherein one of said pair of links is pivotally mounted to a fixed frame.

* * * * *